US006283660B1

(12) United States Patent
Furlong et al.

(10) Patent No.: US 6,283,660 B1
(45) Date of Patent: Sep. 4, 2001

(54) PEN DISPENSING AND CARTRIDGE SYSTEM

(76) Inventors: Patrick J. Furlong, 1218 Latana St., Camarillo, CA (US) 93010; Dennis M. Nakamura, 1100 Moraga Way, Suite 100, Moraga, CA (US) 94556-1146

( * ) Notice: Subject to any disclaimer, the term of this patent is extended or adjusted under 35 U.S.C. 154(b) by 0 days.

(21) Appl. No.: 09/337,561

(22) Filed: Jun. 22, 1999

(51) Int. Cl.[7] ..... B43K 5/14

(52) U.S. Cl. ..... 401/135; 401/66; 401/182

(58) Field of Search ..... 401/65, 66, 132, 401/133, 134, 135, 176, 179, 182; 222/391, 83, 327, 386

(56) References Cited

U.S. PATENT DOCUMENTS

| | | | |
|---|---|---|---|
| 1,671,125 | 5/1928 | Pollock . | |
| 1,688,236 | 10/1928 | Horn . | |
| 2,293,211 | 8/1942 | Mureau | 15/137 |
| 2,642,064 | 6/1953 | Lawshe | 128/216 |
| 2,978,722 | 4/1961 | Kusakabe | 15/555 |
| 3,720,473 | 3/1973 | Nakata | 401/40 |
| 3,739,779 | 6/1973 | Pfleger | 128/218 |
| 3,759,259 | 9/1973 | Truhan | 128/269 |
| 4,027,985 | 6/1977 | Loesser, III | 401/134 |
| 4,040,753 | 8/1977 | Griffith | 401/186 |
| 4,077,550 * | 3/1978 | Van Manen | 222/327 |
| 4,131,217 | 12/1978 | Sandegren | 222/82 |
| 4,148,318 | 4/1979 | Meyer | 128/269 |
| 4,599,008 * | 7/1986 | Furlong et al. | 401/133 |
| 4,657,159 | 4/1987 | Grant | 222/83 |
| 4,688,808 * | 8/1987 | Iijima | 277/223 |
| 4,696,328 | 9/1987 | Rhodes, Jr. | 141/1 |
| 4,854,760 | 8/1989 | Pike et al. | 401/134 |
| 5,372,444 | 12/1994 | Lhuisset | 401/186 |
| 5,573,147 * | 11/1996 | Nilsson et al. | 222/327 |
| 5,879,633 * | 3/1999 | Tervamaki et al. | 422/100 |
| 5,951,186 | 9/1999 | Lhuisset | 401/100 |

FOREIGN PATENT DOCUMENTS

| | | |
|---|---|---|
| 73.21366 | 12/1974 | (FR) . |
| 2606676A | 5/1988 | (FR) . |
| 2738729 | 3/1997 | (FR) . |
| 2198037A | 6/1988 | (GB) . |

* cited by examiner

*Primary Examiner*—Steven O. Douglas
*Assistant Examiner*—Peter deVore
(74) *Attorney, Agent, or Firm*—Lyon & Lyon LLP

(57) ABSTRACT

The present invention features a pen used, for example, to dispense nail polish for finger nail application. The design is for a unit of use, meaning that the preferred pen uses cartridges, i.e., units. In a preferred embodiment, each cartridge is filled with polish and has a brush head. After the cartridge is used, the user simply disposes of the old cartridge and replaces it with a new cartridge for the next application.

7 Claims, 3 Drawing Sheets

PEN DISPENSING AND CARTRIDGE SYSTEM

FIELD OF THE INVENTION

The field of the invention is applicators for paints, medicaments and coatings.

BACKGROUND OF THE INVENTION

The following information is presented solely to assist the understanding of the reader, and none of the information is admitted to describe or constitute prior art to the claims of the present invention.

A requisite for the maintenance of fluids is that they be sealed within a container sufficient to prevent them from breaking down, evaporating, or drying out. A requisite for a disposable container is that it be simple and economical to manufacture and easy to use.

In U.S. Pat. No. 4,599,008, issued Jul. 8, 1986, for a "Fingernail Polish Capsule and Plunger," the disclosure of which is incorporated herein by reference in its entirety, including any drawings, there is a described sealed unit in the form of a cartridge containing nail polish, a slideable brush attachment, a piston, and a plunger. It is to be used in a reusable hand-piece. When the cartridge is placed into the hand-piece, the brush attachment slides axially to automatically force open a panel at one end of the cartridge, that end being closed by a separately formed plug which has a sealed fit in the cartridge. Next, a plunger is utilized to displace a removable panel at the opposite end of the cartridge. That removable panel sits on a piston and is moved into the cartridge by further movement on the plunger which also moves the piston, thereby forcing the liquid nail polish into the brush attachment.

As noted therein, nail polish is customarily sold in bottles with the closure cap having an attached brush which is used to apply the polish. Such bottles contain more polish than is required for a single application so that after used the bottle must be reclosed and stored. Various techniques have been adapted to store such containers, including placing them in refrigerators. It is remarked that there has, however, been no satisfactory and convenient solution to solvent loss. In fact, it is stated, there is a solvent loss in the customary nail polish bottle arrangement during storage. While the invention of the '008 patent is said to solve that solvent loss problem, it has been discovered that various aspects of the device disclosed therein make its use as a disposable application unit inconvenient and expensive. First, the device is complicated from a standpoint of manufacture, containing a number of intricate parts. Additionally, the '008 device must be used with a plunger-containing handpiece.

A self-contained disposable, fluid storing applicator device which is easy to manufacture and use and which need not be used with a handpiece is described in U.S. Pat. No. 4,854,760 which is incorporated herein by reference in its entirety, including any drawings. Optionally, a mechanical dispenser device may be relied on by the user to expel to contents of the container. The container may be used to store and apply or otherwise expel a variety of materials, such as paint, nail polish, and medicaments, including smelling salts and topical pharmaceuticals like iodine.

Nonetheless, there remains a need for additional and improved devices for dispensing fluids.

SUMMARY OF THE INVENTION

The present invention features a pen used, for example, to dispense nail polish for finger nail application (or any other liquid or cream). The design is for a unit of use, meaning that the preferred pen uses cartridges, i.e., units. In a preferred embodiment, each cartridge is filled with polish and has a brush head. After the cartridge is used, the user simply disposes of the old cartridge and replaces it with a new cartridge for the next application.

Also featured are methods of making and using the pens, cartridges and capsules described herein, as well as kits useful in such methods. The components are combined to form the pen, cartridge and capsule and then used to apply the substance being dispensed, for example nail polish. Examples of preferred embodiments of each of the components are summarized herein.

Pen Dispenser

The pen dispenser is the device that dispenses the nail polish or other substances from the cartridge system. The pen preferably uses a ratchet system that advances the rod ratchet a measured amount each time the flow control button is depressed. The button uses a bi-directional ratchet system. Each time the button is depressed it advances the rod ratchet a measured amount and then it returns to its original position by use of a coil spring. When the cartridge is fully dispensed and ready for disposal, the cartridge is rotated counter clockwise and the rotating barrel within the pen also is rotated to expose the flat sides of the rod ratchet which then releases the rod ratchet to its original position by use of a coil spring. The pen is then ready for use with another cartridge.

First Capsule System

The capsule preferably is a tube open at both ends. The ends have a step on each side that can be folded over to seal the ends with a Cap. The tube can be metal, plastic or other material.

Second Capsule System

The capsule preferably is closed at one end and open at the other end. At the closed end there is a coined area in the center that is thinner than the rest of the capsule body. This allows the spike to penetrate the capsule and allow the substance to flow through the spike and into the brush or other applicator. The capsule is filled with the substance to be dispensed and the piston is then inserted into the capsule. The piston prevents the substance from flowing out of the capsule when it is penetrated by the rod ratchet. The open end has a step to allow the cap to seat on the step and have the ends folded over onto the cap creating the seal. The capsule is then penetrated by the rod ratchet from the pen dispenser and it pushes forward the piston which in turn pushes the entire capsule forward in the brush housing causing it to be penetrated by the spike in the coined area of the capsule. As the rod ratchet moves forward it will dispense a measured amount of the substance into the spike and into the brush or other applicator.

Cap

The cap preferably is a circular piece of metal, plastic or other material that is used to seal the capsule. In the first capsule design two caps are needed, one for each end. In the second capsule design only one cap is needed to seal the open end of the capsule.

Spike

The spike preferably is identical on both ends. There is a hole that runs through the center of the spike. Both ends have a very sharp tip that is used to penetrate the capsule. Once the capsule is penetrated the substance to be dispensed flows through the hole in the center of the spike. At the other end of the spike the substance flows into either a brush fiber or other type of applicator which can be a foam tip, sponge or nothing at all. The spike is held in the brush housing using a tension fit between the spike, brush housing and fiber.

Piston

The piston can be made of plastic, metal or other material. It is inserted into the capsule after the substance to be dispensed is filled in the capsule. The hollow end is inserted first. The purpose of the piston is to prevent the flow of the substance to be dispensed from leaking back out behind the piston and into the pen Dispenser once the seal has been penetrated.

Brush Housing

The brush housing holds the capsule in place before it is ready to be dispensed. When the brush housing is inserted into the pen dispenser and is turned clockwise it turns the rotating barrel inside the pen dispenser. As the brush housing rotates it eventually stops after rotating 90 degrees and the rod ratchet starts to penetrate the sealed end of the capsule. The capsule then starts to move forward within the brush housing and then the coined end of the capsule is penetrated by the spike. As the rod ratchet moves forward it moves the piston forward and dispenses the substance inside the capsule. After the capsule is dispensed the brush housing is turned counter clockwise and also turns the rotating barrel. The rotating barrel then turns the rod ratchet to expose the flat sides of the rod ratchet and then releases the rod ratchet to return to its original position.

The summary of the invention described above is not limiting and other features and advantages of the invention will be apparent from the following detailed description of the invention and from the claims.

DETAILED DESCRIPTION OF THE PREFERRED EMBODIMENTS

Figure 1:
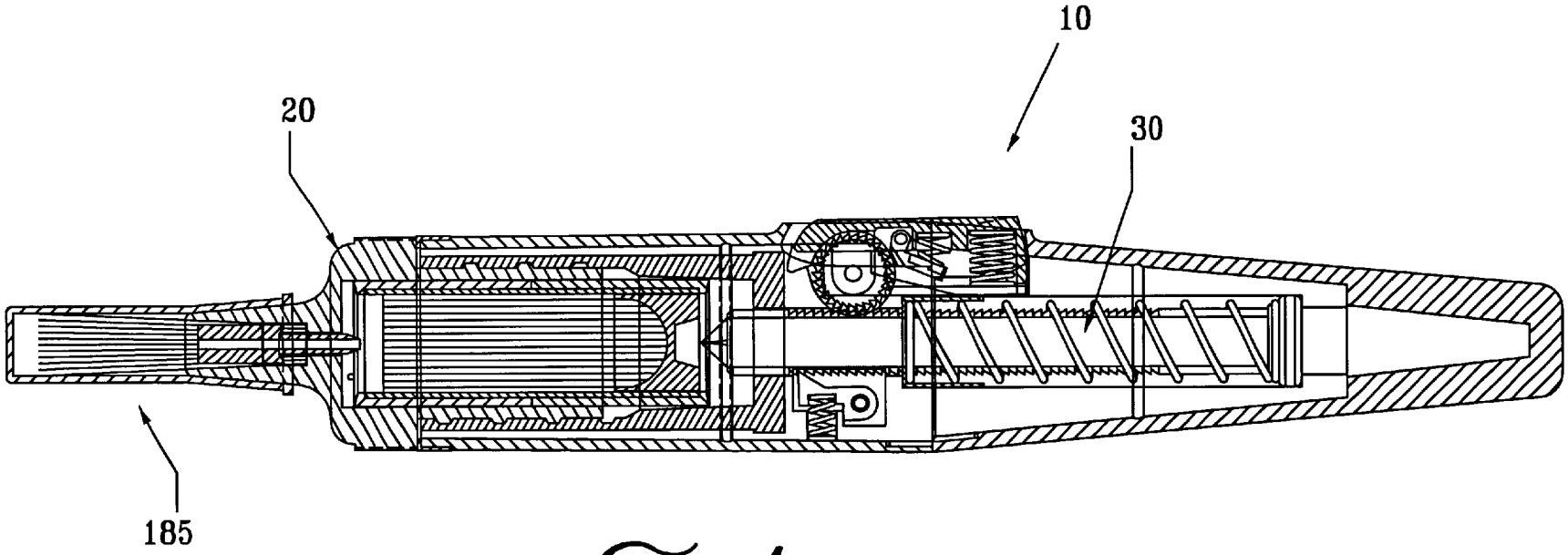
FIG. 1 shows a pen assembly, a brush and capsule assembly and a protective sleeve.
Figure 2:
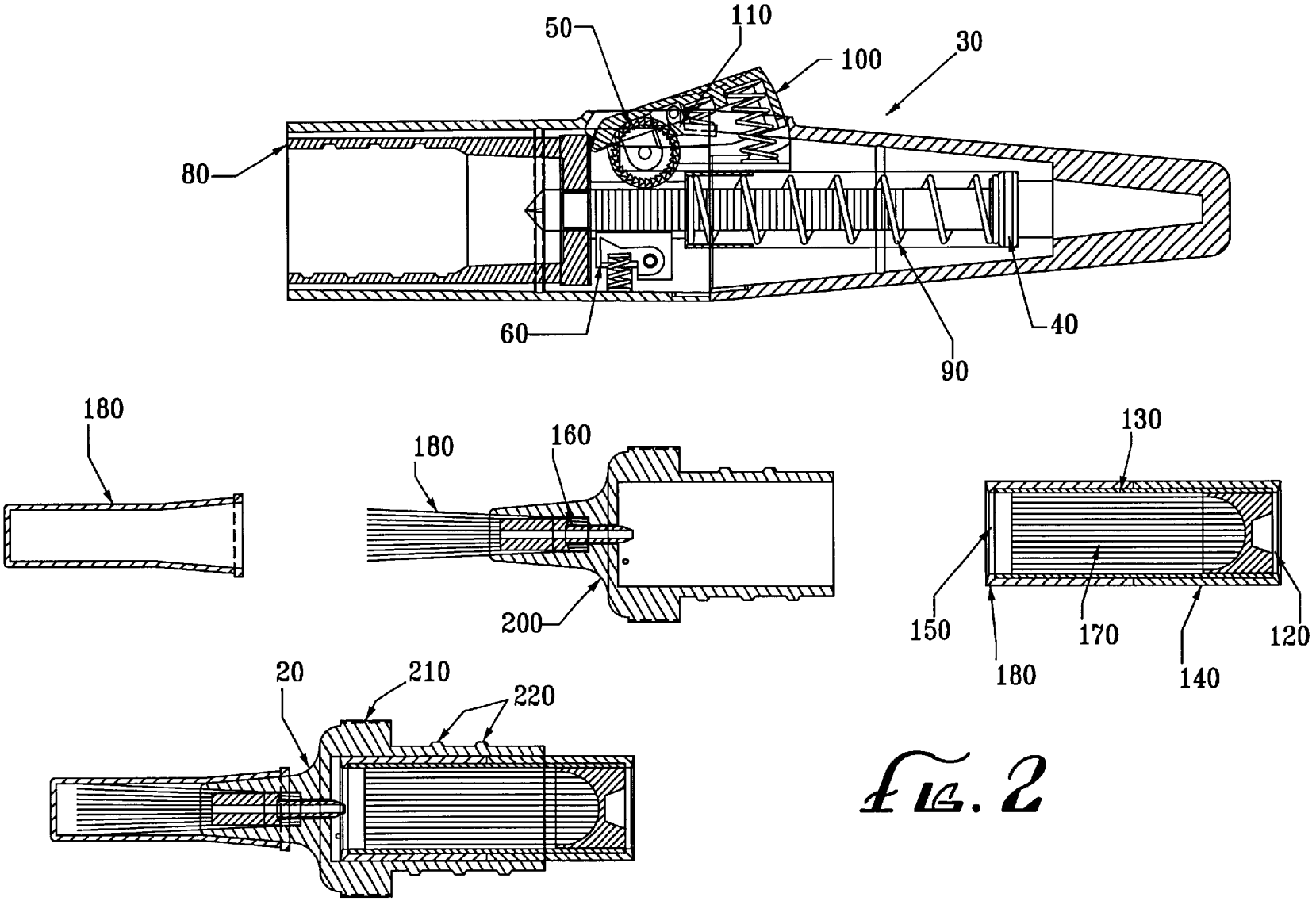
FIG. 2 shows various detailed views of preferred components of the invention.
Figure 3:
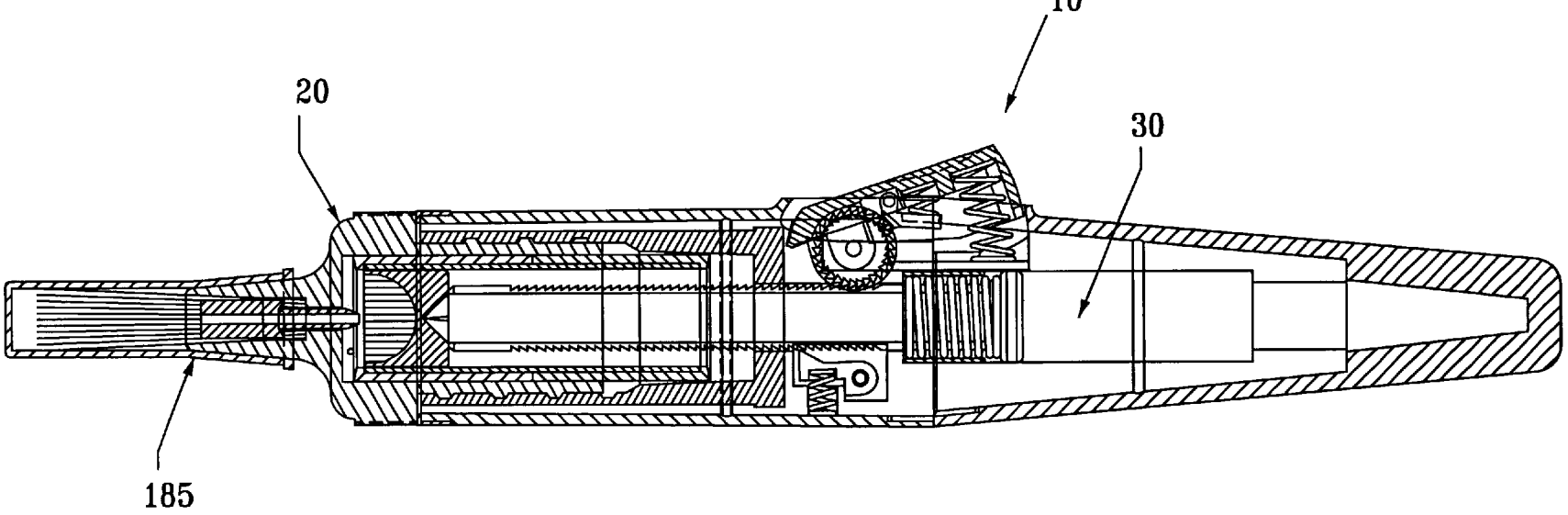
FIG. 3 shows a nail polish transfer hole in addition to the components featured in FIG. 1.

In a preferred embodiment, the pen and cartridge system 10 works in the following manner. The user inserts a cartridge 20 into the pen dispenser 30. A spring loaded rod ratchet 40 is in a fully retracted position and the pen dispenser 30 is not engaged either to the ratchet wheel 50 or bottom ratchet 60. As the user screws the cartridge 20 into the pen handle 70 using a clockwise rotation, the cartridge 20 continues to turn until it becomes snug. At this point the user continues to rotate the cartridge another 90 degrees. This causes the rotating sleeve 80 to turn and the rod ratchet 40 to also turn 90 degrees. At this point the rod ratchet 40 then engages both the ratchet wheel 50 and bottom ratchet 60.

This is achieved by using a rod ratchet 40 that has evenly spaced ratcheting teeth, but has a flat surface on two parallel opposite sides. When the rod 40 is turned 90 degrees it engages. When it is turned back 90 degrees the flat surfaces are then exposed to the ratchet wheel 50 and bottom ratchet 60. Since at this point there is now nothing to hold to the rod ratchet 40 it is pushed by the spring 90 and freely retracts back into the pen dispenser 30.

The rod ratchet 40 now being engaged, can be advanced by pressing down on the flow control button 100 which in turn presses down on the spring loaded top ratchet 110 which in turn advances the bi-directional ratchet wheel 50 a single notch. The bi-directional ratchet 50 wheel is designed with two sets of teeth, the inside set runs one direction while the outside set runs in the opposite direction. This system allows the top ratchet 110 to advance the ratchet wheel 50 and rod ratchet 40 in the same direction.

As the user presses the button 100 the rod ratchet 40 advances. As it advances it breaks through the thin rear membrane 120 of the capsule 130 after which it contacts the piston 140. At the same time, the forward motion of the rod ratchet 40 against the rear of the capsule 130 forces the forward membrane 150 to be penetrated by the spike 160 creating an exit point for the nail polish 170 on to the brush 180, which maybe covered by protective sleeve 185. Once contact is made with the piston 140 it begins to move forward pushing the nail polish 170 out of the capsule 130 through the small exit hole created by the spike 160. Finally the rod ratchet 40 continues to move forward as the user pushes down the flow control button 100 and forces all of the nail polish 170 out of the capsule 130 and on to the brush 180 for application.

After the nail polish application is completed the user simply turns the used cartridge 20 counter clockwise. This motion now turns the rotating sleeve 80 and rod ratchet 40 the opposite direction 90 degrees exposing the flat sides of the rod ratchet 40 to the ratchet wheel 50 and bottom ratchet 60. Since there is now nothing to keep the rod ratchet 40 in the forward position, the spring 90 now forces it back into the pen dispenser 30 and ready for the next application.

EXAMPLES

The following examples are offered by way of illustration and are not intended to limit the scope of the invention in any manner.

Example A

First Capsule Assembly Process

In order to construct the first capsule 130, the following steps are performed.

1. Crimp one end of the Capsule 130 with the Cap 190.
2. Fill the Capsule 130 with substance 170.
3. Insert Piston 140.
4. Seal the Capsule 130 using the Cap 190 and crimping over the ends of the Capsule 130.
5. Insert filled Capsule 130 into the Brush Housing 200.

After the following steps have been performed, the process yields the first capsule device.

Example B

Second Capsule Assembly Process

In order to construct the second capsule, the following steps are performed.

1. Fill the Capsule 130 with substance 170.
2. Insert Piston 140.
3. Seal the Capsule 130 using the Cap 190 and crimping over the ends of the Capsule 130.
4. Insert the filled Capsule 130 into the Brush Housing 200.

After the following steps have been performed, the process yields the second capsule device.

In one embodiment of the pen and cartridge system, brush housing 200 has fins 210 for the user to grip and manipulate for turning the brush housing when it is inserted into pen dispenser 30, and tension bumps 220 that hold capsule 130 inside the brush housing.

One skilled in the art would readily appreciate that the present invention is well adapted to carry out the objects and obtain the ends and advantages mentioned, as well as those inherent therein. The devices and the methods, procedures, treatments, and specific kits described herein are presently representative of preferred embodiments are exemplary and are not intended as limitations on the scope of the invention. Changes therein and other uses will occur to those skilled in the art which are encompassed within the spirit of the invention are defined by the scope of the claims.

It will be readily apparent to one skilled in the art that varying substitutions and modifications may be made to the invention disclosed herein without departing from the scope and spirit of the invention.

All patents and publications mentioned in the specification are indicative of the levels of those skilled in the art to which the invention pertains. All patents and publications are herein incorporated by reference to the same extent as if each individual publication was specifically and individually indicated to be incorporated by reference.

The invention illustratively described herein suitably may be practiced in the absence of any element or elements, limitation or limitations which is not specifically disclosed herein. Thus, for example, in each instance herein any of the terms "comprising", "consisting essentially of" and "consisting of" may be replaced with either of the other two terms. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

In addition, where features or aspects of the invention are described in terms of Markush groups, those skilled in the art will recognize that the invention is also thereby described in terms of any individual member or subgroup of members of the Markush group. For example, if X is described as selected from the group consisting of bromine, chlorine, and iodine, claims for X being bromine and claims for X being bromine and chlorine are fully described.

Those references not previously incorporated herein by reference, including both patent and non-patent references, are expressly incorporated herein by reference for all purposes. Other embodiments are within the following claims.

We claim:

1. A pen dispenser for dispensing a substance, comprising:

a disposable cartridge filled with the substance being dispensed and a brush housing unit;

a rotating sleeve capable of accepting said cartridge, a spring loaded rod ratchet, a ratchet wheel and a bottom ratchet, wherein said rod ratchet engages both the ratchet wheel and the bottom ratchet; and a flow control button which advances the rod ratchet a specifically measured distance which in turn presses down on a spring loaded top ratchet which in turn advances a bi-directional ratchet wheel a single notch, wherein said bi-directional ratchet wheel comprises two sets of teeth, an inside set that runs one direction and an outside set that runs in the opposite direction, thereby allowing the top ratchet to advance the ratchet wheel and rod ratchet in the same direction.

2. The pen dispenser of claim 1, wherein said rod ratchet advances and breaks through a thin cap membrane of a capsule and contacts a piston and at the same time the forward motion of the rod ratchet against the closed end of the capsule forces a coined area to be penetrated by a spike creating an exit point for the substance being dispensed into the brush, wherein the piston pushes the substance being dispensed out of the capsule through the small exit hole created by the spike.

3. The pen dispenser of claim 2, wherein the rotating sleeve turns 90 degrees exposing the flat sides of the rod ratchet to the ratchet wheel and bottom ratchet and the spring forces the rod ratchet back into the pen dispenser.

4. A cartridge system comprising:

a brush housing unit and a metal or plastic capsule having a first end and a second end, said second end being hermetically sealed by a membrane made of metal or plastic, the capsule containing a liquid or cream substance;

wherein the brush housing screws or is pushed and locked into a pen dispenser and a rod ratchet pushes the capsule forward inside the brush housing and into a spike, thereby penetrating a coined end of the capsule.

5. The cartridge system of claim 4, where the first end of the capsule has a coined area in the middle of the capsule that is thinner than the rest of the capsule and rod ratchet penetrates the second end of the capsule.

6. The cartridge system of claim 5, where the capsule comprises a metal or plastic piston that slides down the middle of the capsule forcing a substance being dispensed through the spike and into brush fibers without allowing the substance being dispensed to leak out behind the piston.

7. The cartridge system of claim 6, wherein said brush housing contains a spike and thereby produces a center feed brush unit whereby the substance being dispensed flows through the center of the brush or other applicator which can be a foam tip, sponge, cotton or plastic tip and out into the tip of the applicator.

* * * * *